United States Patent [19]

Evans

[11] Patent Number: 4,974,733

[45] Date of Patent: Dec. 4, 1990

[54] INCLINED VERTICAL FILE ASSEMBLY FOR ATTACHMENT TO A DESK ACCESSORY

[75] Inventor: Dale M. Evans, Windsor, Wis.

[73] Assignee: Don Evans, Inc., DeForest, Wis.

[21] Appl. No.: 392,586

[22] Filed: Aug. 11, 1989

[51] Int. Cl.[5] ..... A47F 7/00

[52] U.S. Cl. ..... 211/11; 211/128

[58] Field of Search ..... 211/11, 128, 126, 10, 211/50, 55; 40/124; D19/90

[56] References Cited

U.S. PATENT DOCUMENTS

| | | | |
|---|---|---|---|
| D. 290,141 | 6/1987 | Rabig . | |
| D. 295,540 | 5/1988 | Rabig . | |
| 2,769,550 | 11/1956 | Rollins et al. | 211/11 |
| 4,074,810 | 2/1978 | Juergens et al. | 211/11 |
| 4,438,852 | 3/1984 | Evans . | |
| 4,657,148 | 4/1987 | Heng | 211/128 |

OTHER PUBLICATIONS

Exhibit A–Collection of Catalogue Pages, Published in 1988 or Earlier.

Exhibit B–Advertising Brochure, Create–A–System, Evco Office Products.

May 3, 1988, p. 553, Official Gazette, Referring to Design Patent 295,540 Assigned to Sterling Plastic Company.

Jun. 2, 1987, p. 626, Official Gazette, Referring to Design Patent 290,141 Assigned to Sterling Plastic Company.

*Primary Examiner*—David M. Purol

*Assistant Examiner*—Sarah A. Lechok

*Attorney, Agent, or Firm*—Quarles & Brady

[57] ABSTRACT

A vertical file assembly which is easy and less costly to manufacture with injection molding techniques has (1) a divider unit with spaced apart dividers rising from an integral base panel to form compartments for books, catalogs, file folders and documents and (2) two wedge-shaped adapters each with a pair of barbed projections projecting inwards from an upper edge. These projections are inserted in receiving slots and latched in apertures formed in the bottom of the base panel of the divider unit. When the adapters and divider unit are assembled, the base panel slants upward from front to back to elevate each divider a certain measure above the preceding divider. The wedge-shaped adapters also have tabs with ledge portions which slide along the sidewalls and are caught in niches in the sidewalls of a supporting letter tray.

10 Claims, 3 Drawing Sheets

FIG. 1
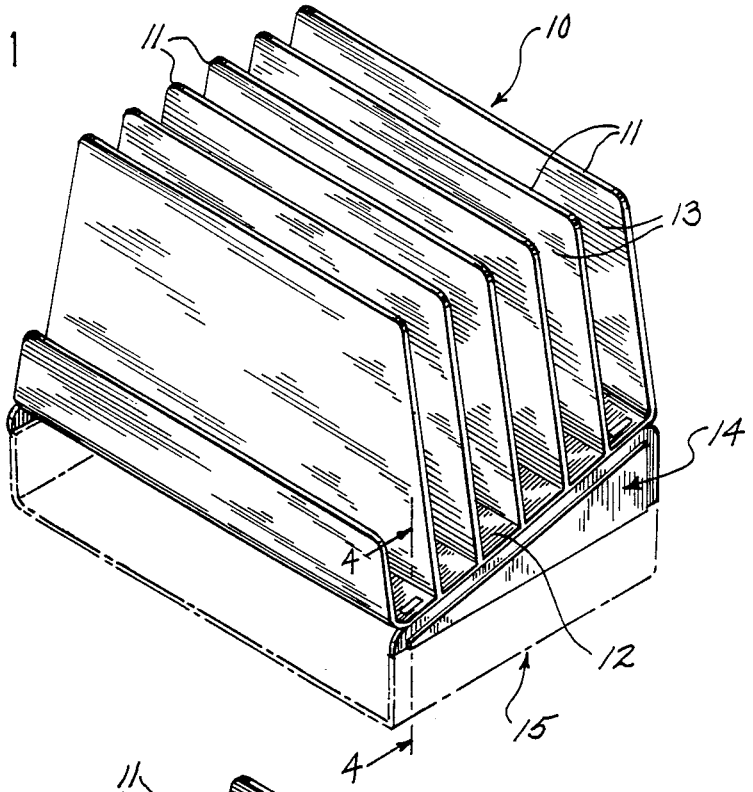
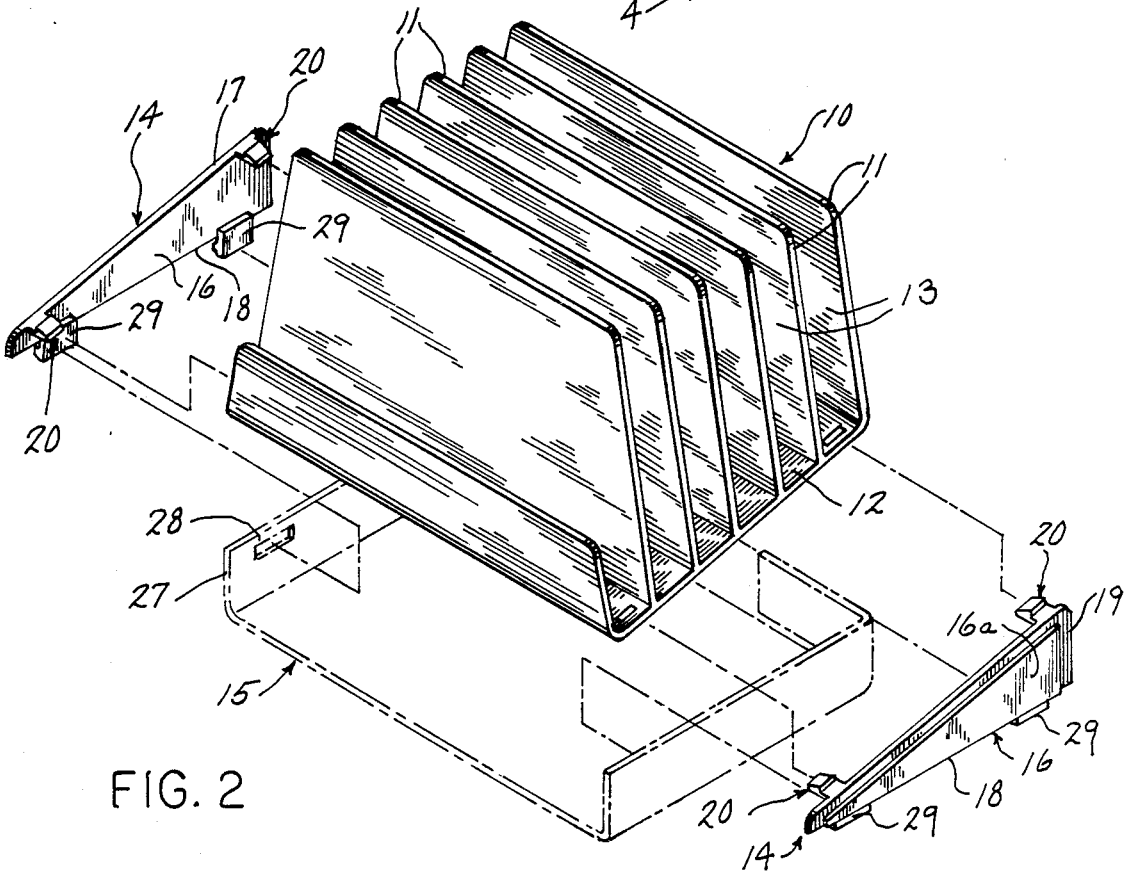
FIG. 2

INCLINED VERTICAL FILE ASSEMBLY FOR ATTACHMENT TO A DESK ACCESSORY

BACKGROUND OF THE INVENTION

1. Field of the Invention

The field of the invention is desktop files and organizers, and in particular vertical files with spaced vertical dividers supported on an inclined base.

2. Background Art

In desktop files and organizers with vertical dividers, it has been found to be advantageous to place the dividers on an inclined base to expose the upper edge portions of file jackets, books, catalogs and documents which are stored in such desktop organizers.

Many desktop files and organizers are made by injection molding of plastics although metal and wire products are also known.

It has been known to mount such vertical files in piggyback fashion on horizontal letter trays as demonstrated in Rabig, U.S. Design Pat. No. 290,141, issued June 2, 1987.

The above-mentioned vertical file exhibits a very slight angle of inclination relative to horizontal. When this angle is increased to provide greater inclination of the vertical file, the depending skirt becomes much larger and the file begins to assume a more complex shape for molding purposes.

The manufacture of these devices using injection molding methods requires a mode of construction which is the most economical, because the market is sensitive to price as well as style.

SUMMARY OF THE INVENTION

The invention relates to a 3-part construction for assembling a vertical file having a plurality of transverse dividers which define a plurality of compartments for holding documents, file folders and the like.

The invention provides a file divider unit and first and second wedge-shaped adapters, each adapter having a lower edge and having an upper edge forming an acute angle with the lower edge.

Generally speaking, the wedge-shaped adapters of the invention include a first means for attachment to the file divider unit and a second means for attachment to a supporting desk accessory.

In a preferred example described herein, the wedge-shaped adapters each have a pair of barbed projections extending inwardly and laterally from their upper edges for attaching their upper edges to respective bottom side portions of an inclined base panel on the divider unit. When so attached, the wedge-shaped adapters elevate the base panel and hold the spaced apart dividers in a substantially vertical direction relative to the lower edges of the adapters, which lie in a plane substantially parallel to a desktop.

The wedge-shaped adapters each have a set of tabs which extend downwardly from their lower edges and include ledges and notches for an interlocking attachment to a supporting desk accessory.

One object of the invention is to provide a vertical file assembly which is easier and less expensive to manufacture.

Another object of the invention is to provide a vertical file assembly that is easy and securely assembled, and easily and securely attached to other desk accessories.

Other objects and advantages besides those discussed above shall be apparent to those experienced in the art from the description of a preferred embodiment of the invention which follows. In the description, reference is made to the accompanying drawings, which form a part hereof, and which illustrate one example of the invention. Such example, however, is not exhaustive of the various alternative forms of the invention, and therefore reference is made to the claims which follow the description for determining the scope of the invention.

BRIEF DESCRIPTION OF THE DRAWINGS

FIG. 1 is a perspective view of the file assembly of the present invention, mounted on a supporting desk accessory shown in phantom;

FIG. 2 is an exploded view showing the parts of the assembly of FIG, 1;

DETAILED DESCRIPTION OF THE PREFERRED EMBODIMENT

Figure 7:
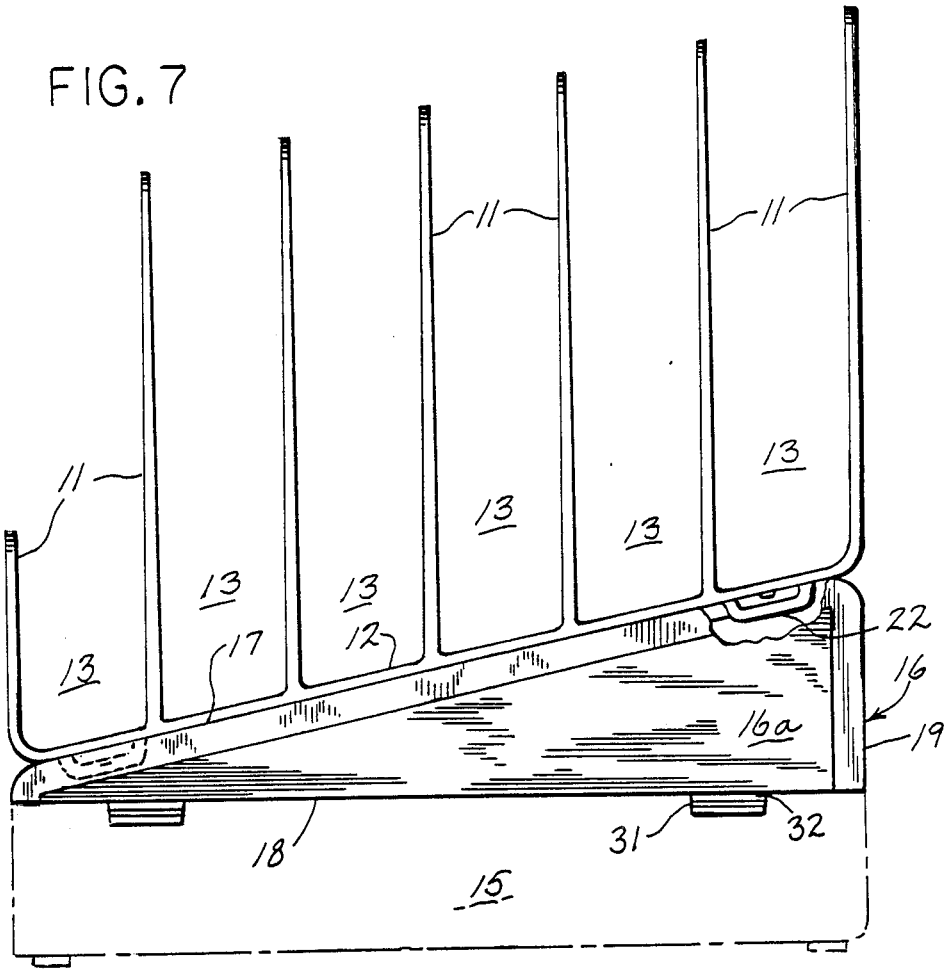
FIG. 7 is a side view in elevation of the file assembly and desk accessory shown in FIG. 1.

Referring to FIG. 1, 2 and 7, a vertical file assembly which is easy and less costly to manufacture with injection molding techniques includes a file divider unit 10 with spaced apart dividers 11 rising at an acute angle from an integral base panel 12 to form compartments 13 for books, catalog, file folders and documents.

The file assembly also includes two wedge-shaped adapters 14 which when assembled to the divider unit 10, slant the base panel 12 upward from front to back to elevate each divider 11 a certain measure above the preceding divider 11. The front divider 11 is less than half the height of the others, as seen best in FIG. 7.

The vertical file assembly is made for attachment to supporting desk accessories which may include one or several stacked horizontal letter trays 15. These trays 15 can be stacked one on top of the other to provide a horizontal sorting file, and the vertical file assembly can be mounted on the top tray 15.

The file divider unit 10 is formed as an integral unit by injection molding. As seen in FIGS. 1 and 2, the dividers 11 are trapezoidal in shape. They are spaced along the length of the integrally formed base panel 12 from front to back and they extend transversely from one side of the base panel 12 to the other to define transverse compartments 13.

The wedge-shaped adapters 14 include triangular side panels 16 each with an upper edge 17 slanting upward at an acute angle with respect to a lower edge 18. The triangular side panels 16 have a triangular embossment **16*a* which is smaller in area than the side panel 16 to present a recessed edge area along the upper edge 17 and back edge 19 of the adapter 14**.

The adapters 14 are secured to the divider unit 10 by four fasteners formed along their upper edges 17 to attach to four corner portions of the divider unit 10. The fastening locations are spaced longitudinally along the upper edge 17 of each adapter side panel 16 and opposite a similar pair of fasteners on the other side panel 16.

Figure 3:
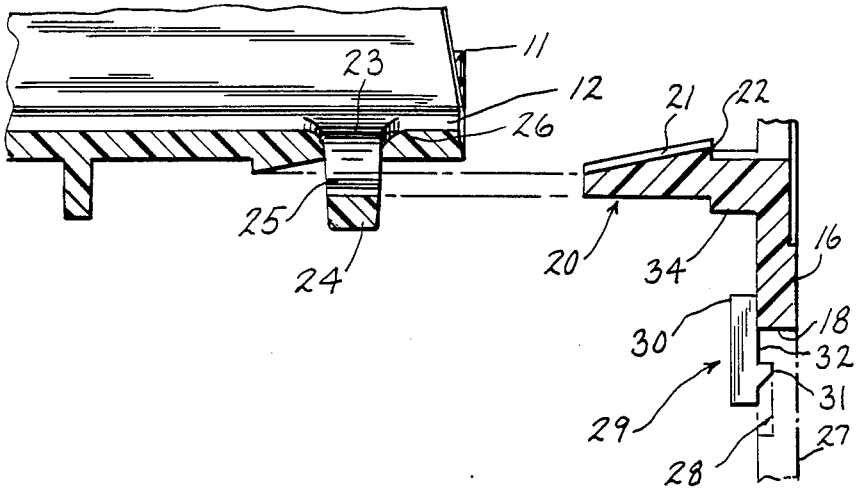
FIG. 3 is a sectional view in the same plane as FIG. 4 with the parts separated in the manner of FIG. 2.
Figure 4:
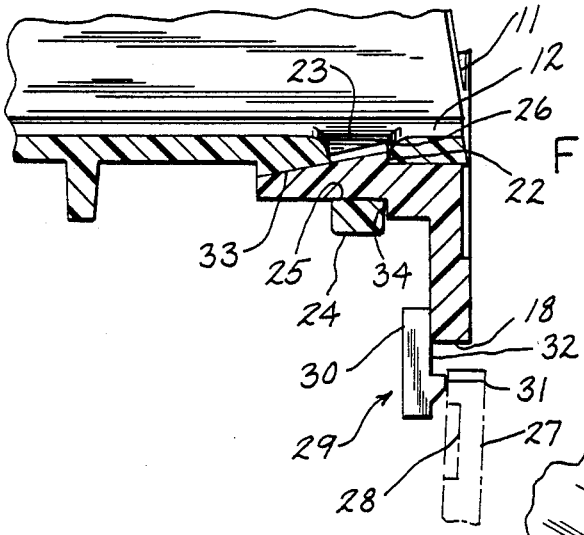
FIG. 4 IS a sectional view taken in the plane indicated by lines 4—4 in FIG. 1.
Figure 5:
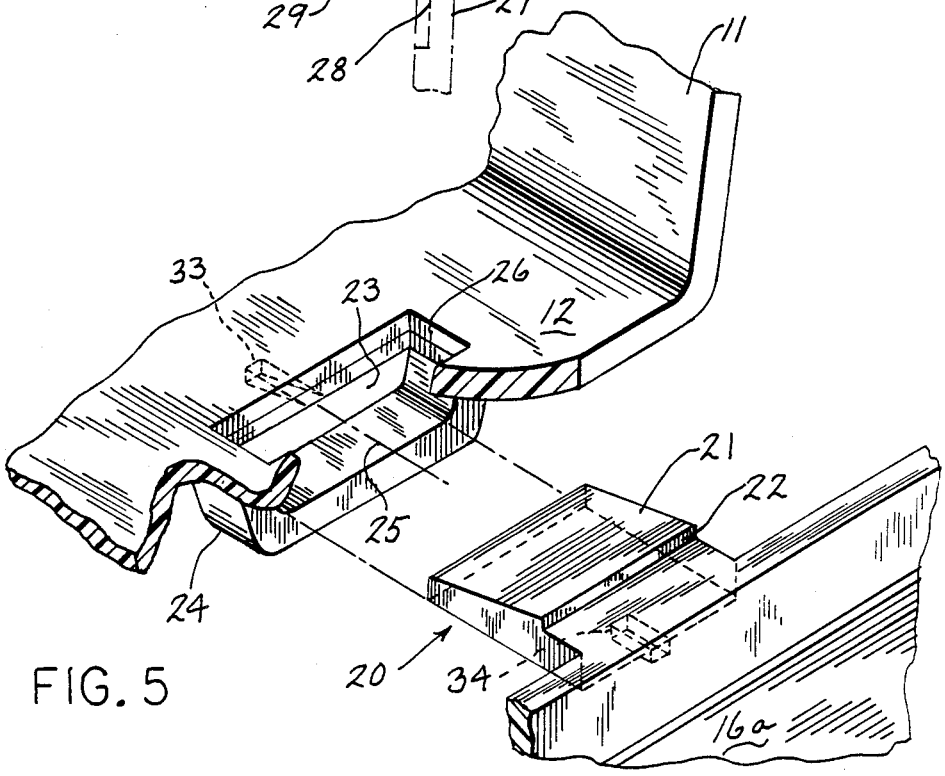
FIG. 5 is a detail perspective view of the parts shown in FIGS. 3 and 4.

FIGS. 3–5, shows one of these fasteners at the front, right-hand corner of the assembly of FIG. 1. Each fastener includes a laterally and inwardly extending projection 20 with a wedge-shaped head 21 that forms a barb 22 at the back of the head 21 to hold the head in place. The projection 20 extends at approximately 90° from the inner surface of the side panel 16.

In the first and last compartments 13 of the divider unit 10, in portions along the two respective sides of the base panel 12, there are apertures 23 formed in the base panel and integral loops 24 which run below the apertures 23 as seen best in FIG. 5. These loops 24 and the side portions of the base panel 12 around the apertures 23 form receiving slots 25 in which the barbed projections 20 are received. The barbed portions 22 are caught on the edges 26 formed around the base panel aperture 23 as seen in FIG. 4 and secured there to fasten the adapters 14 to the divider unit 10.

As seen in FIG. 5 there are wedge-shaped guide members 33 formed on the bottom of the base panel 12 for sliding contact with angled portions of the head 21 of projections 20 as the projections 20 are inserted into their fastening position. On the bottom of the projections 20 are small, elongated stop ridges 34 positioned so that one end abuts one of the loops 24 to limit the depth of insertion of the projections 20.

The file assembly is assembled by inserting the projections 20 in corresponding slots 25 to a depth where the barb 22 is caught and latched on the edge 26 defined by the respective base panel aperture 23. The angled portion of the heads 21 are held snugly against the guide members 33 to prevent the adapter side panels 16 from wiggling in a lateral direction.

When the adapters 13 are assembled to the divider unit 10, as seen in FIG. 1, the base panel 12 is slanted upward from front to back and the dividers 11 are oriented in a substantially vertical direction relative to the lower edges 18 of the adapters 13. As seen in FIGS. 1 and 2, the entire file assembly can be mounted on a supporting desk accessory such as letter tray 15.

Figure 6:
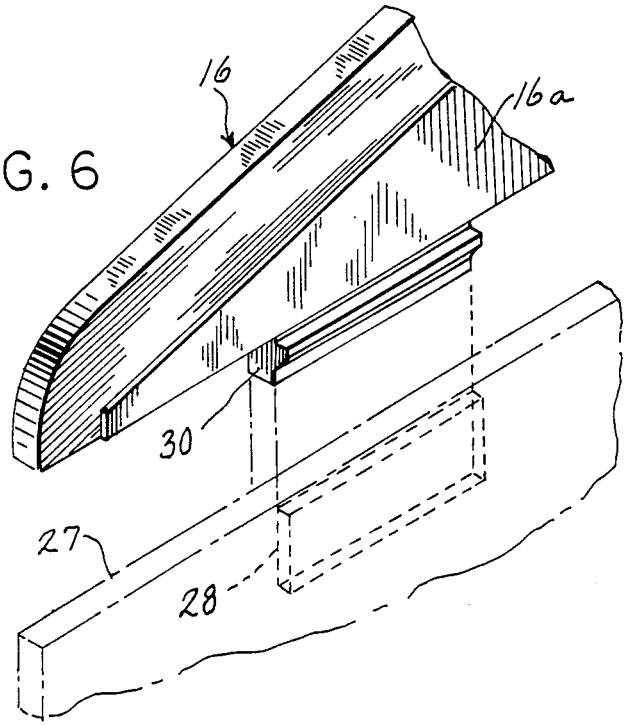
FIG. 6 is a detail exploded view showing the attachment of the file assembly of FIG. 1 to the supporting desk accessory.

As seen in more detail in FIGS. 2, 3 and 4, the letter tray 15 is formed with upstanding sidewalls 27 and niches 28 on the inner sides of these sidewalls 27. Referring to FIGS. 3 and 4, the two wedge-shaped adapters 14 each have a pair of downwardly extending tabs 29 spaced longitudinally along their bottom edges 18 and positioned generally beneath the fasteners formed along the upper edges. The tabs 29 are integrally formed with the side panels 16 and each has a stem 30 which is offset to the inside of the side panel 16. A projecting ledge 31 is formed to extend transversely across the outside of the stem 30 as seen best in FIG. 6. Referring back to FIGS. 3, 4 and 7, this forms a notch 32 between the ledge 29 and lower edge 18 of the side panel 16.

To attach the vertical file assembly to the desk tray 15, the wedge adapters 14 are pressed downward. The tabs 29 and the sidewalls 27 are made sufficiently flexible, so that the tabs 29 slide along the inner sides of the tray sidewalls 27 until the ledges 31 become lodged in the niches 28. An upper edge portion of the tray sidewall 27 is then positioned in the notch 32 for an interlocking and secure attachment as seen best in FIG. 3.

From the above description it should now be apparent that the integral divider unit 10 and two integral wedge adapters 14 provide a vertical file assembly which is easy to put together and attach to a supporting desk accessory. The manufacture of the file assembly as three parts provides for a better mode of mold design and manufacture as compared to making the vertical file as an integral unit.

The above description has been that of a preferred embodiment of the present invention. It will occur to those who practice the art that man modifications may be made without departing from the spirit and scope of the invention. In order to apprise the public of the various embodiments that may fall within the scope of the invention, the following claims are made.

I claim:

1. An inclined vertical file assembly for attachment to a desk accessory having substantially horizontal upper surfaces, comprising:

a file divider unit having a base and having a plurality of dividers extending transversely across the base and rising at an acute angle from the base;

a first and second wedge adapter each having an inclined upper edge and a lower edge;

first means for attaching the inclined upper edges of the wedge adapters to the base of the file divider unit, such that the base is held at an incline with respect to the horizontal upper surfaces of the desk accessory and the dividers are held in a substantially vertical position; and second means for attaching the lower edges of the wedge adapters to the horizontal upper surfaces of the desk accessory.

2. The inclined vertical file assembly of claim 1 wherein the first means for attaching the upper edges of the wedge adapters to the base comprises horizontal projections extending from the upper edge of the wedge adapters, and means on the base for receiving the horizontal projections.

3. The inclined vertical file assembly of claim 2 wherein the means on the base for receiving the horizontal projections includes latching apertures and wherein the horizontal projections include barbs that are retained in the latching apertures.

4. A file assembly for attachment to a supporting desk accessory, the file assembly comprising:

a base panel with two opposite side portions;

a plurality of transverse dividers spaced longitudinally along the base panel to define a plurality of compartments for holding documents, file folders and the like, the dividers rising at an acute angle from the base panel;

first and second wedge-shaped adapters, each adapter having a lower edge and having an upper edge forming an acute angle with the lower edge;

means positioned along the upper edges of the wedge-shaped adapters for attaching the upper edges to respective side portions of the base panel, the wedge-shaped adapters elevating the base panel along an incline and providing orientation for the spaced apart dividers in a substantially vertical direction relative to the lower edges of the adapters; and means positioned along the lower edges of the wedge-shaped adapters for securing the file assembly to a supporting desk accessory.

5. The file assembly of claim 4, wherein the two opposite side portions of the base panel are formed with downwardly opening apertures and with looped portions extending downwardly from the base panel apertures to provide laterally directed receiving slots; and wherein the means positioned along the upper edges of the wedge-shaped adapters for attaching the upper edges to respective side portions of the inclined base panel includes barbed projections extending laterally and inwardly from the wedge-shaped adapters for insertion into the receiving slots and retention in the apertures formed in the base panel.

6. The file assembly of claim 5, wherein there is a pair of looped portions spaced from each other along each side portion of the base panel, and wherein there are a pair of barbed projections spaced from each other along each side portion of the wedge-shaped adapters in positions opposite the laterally-directed receiving slots formed by respective looped portions.

7. The file assembly of claim 4, wherein the supporting desk accessory has opposite upstanding sidewalls having inner sides, the inner sides having niches formed therein; and wherein the means positioned along the lower edges of the wedge-shaped adapters for securing the file assembly to the supporting desk accessory includes tabs that extend downwardly from the lower edges of the wedge-shaped adapters, the tabs being formed with laterally extending ledge portions, the wedge-shaped adapters being yieldable to allow lateral movement of the ledge portions and sliding movement into the niches.

8. The file assembly of claim 7, wherein a pair of the niches are spaced longitudinally from each other along each side of the supporting desk accessory, and wherein a pair of tabs with ledge portions are spaced longitudinally from each other along a lower edge of each of the wedge-shaped adapters in positions corresponding to the positions of the niches.

9. The file assembly of claim 4, wherein the base panel, the plurality of spaced dividers, the first and second wedge-shaped adapters, the means positioned along the upper edges of the wedge-shaped adapters for attaching the upper edges to respective side portions of the inclined base panel, and the means positioned along the lower edges of the wedge-shaped adapters for securing the file assembly to a supporting desk accessory are all made of plastic.

10. The file assembly of claim 4, wherein:

the base panel and transverse dividers are integrated into a file divider unit; and wherein the means for attaching the upper edges of the wedge-shaped adapters is integral to the respective wedge-shaped adapters; and wherein the means for securing the file assembly is integral to the respective wedge-shaped adapters.

* * * * *